US005221466A

United States Patent [19]

Garcia et al.

[11] Patent Number: 5,221,466

[45] Date of Patent: Jun. 22, 1993

[54] PHOSPHATE ROCK BENEFICATION

[75] Inventors: Steven C. Garcia, Mulberry; Charles T. Staniek, Lakeland, both of Fla.

[73] Assignee: Freeport-McMoRan Resource Partners, Limited Partnership, New Orleans, La.

[21] Appl. No.: 814,437

[22] Filed: Dec. 30, 1991

Related U.S. Application Data

[63] Continuation-in-part of Ser. No. 711,105, Jun. 3, 1991, abandoned, which is a continuation of Ser. No. 362,225, Jun. 7, 1989, abandoned, which is a continuation-in-part of Ser. No. 340,715, Apr. 20, 1989, abandoned.

[51] Int. Cl.[5] ..... B03D 1/008; B03D 1/02

[52] U.S. Cl. ..... 209/166; 209/167

[58] Field of Search ..... 209/166, 167, 902

[56] References Cited

U.S. PATENT DOCUMENTS

| | | | |
|---|---|---|---|
| 2,156,245 | 4/1939 | Meade | 209/166 |
| 2,293,640 | 8/1942 | Crago | 209/166 |
| 3,032,189 | 5/1962 | Adam | 209/166 |
| 3,067,875 | 12/1962 | Fenske | 209/166 |
| 3,098,817 | 7/1963 | Baarson | 209/166 |
| 3,259,326 | 7/1966 | Duke | 209/166 |
| 3,302,785 | 2/1967 | Greene | 209/166 |
| 3,314,537 | 4/1967 | Greene | 209/166 |
| 3,454,159 | 7/1969 | Hollingsworth | 209/166 |
| 4,152,398 | 5/1979 | Larson | 423/167 |
| 4,324,653 | 4/1982 | Henchiri et al. | 209/167 |
| 4,364,824 | 12/1982 | Snow | 209/167 |
| 4,436,616 | 3/1984 | Dufuor | 209/166 |
| 4,459,237 | 7/1984 | Bresson et al. | 260/455 |
| 4,486,301 | 12/1984 | Hsieh et al. | 209/167 |
| 4,556,545 | 12/1985 | Cheruvu | 423/167 |
| 4,609,535 | 9/1986 | Thomas | 423/167 |
| 4,642,181 | 2/1987 | Polinsky et al. | 209/167 |
| 4,747,941 | 5/1988 | Polinsky et al. | 209/167 |
| 4,867,867 | 9/1989 | Lilley | 209/166 |
| 4,904,375 | 2/1990 | Snow | 209/166 |

FOREIGN PATENT DOCUMENTS

| | | | |
|---|---|---|---|
| 1219003 | 2/1964 | Fed. Rep. of Germany . | |
| 200081/4 | 3/1983 | German Democratic Rep. . | |
| 839574 | 6/1981 | U.S.S.R. | 209/166 |

OTHER PUBLICATIONS

Kirk Othmer Encyclopedia of Clinical Technology 3rd Edition pp. 748-764 "*Silica*".

"Phosphoric Acid, Phosphates and Phosphatic Fertilizers", Wm. H. Waggaman, American Chemical Society Monograph Series, (Facsimile of the 1952 edition), Section Edition, pp. 56-67.

"Study of Selectivity between Apatite and Calcite during Flotation", by Nils Johan Bolin, Division of Mineral Processing, Technical University of Lulea, S-951 87, Lulea, Sweden.

*Primary Examiner*—Thomas M. Lithgow

*Attorney, Agent, or Firm*—Fisher, Christen & Sabol

[57] ABSTRACT

This invention provides an improved method for the rougher flotation of phosphate ore using sodium carbonate to control the pH at about 9.6-10.5. The method facilitates improved recovery of phosphate from its ore; in addition the Bone Phosphate of Lime (BPL) of the phosphate concentrate increases, which provides further advantages in that subsequent steps are improved by virtue of receiving a feed of greater purity. There are also certain environmental advantages obtained when ammonia is replaced with sodium carbonate and the operational safety of the flotation system is enhanced when ammonia is replaced with sodium carbonate.

13 Claims, 3 Drawing Sheets

PHOSPHATE ROCK BENEFICATION

This application is a continuation-in-part of U.S. Ser. No. 07/711,105 filed Jun. 3, 1991 now abandoned which is a continuation of 07/362,225 filed Jun. 7, 1989 now abandoned which is a continuation-in-part of U.S. application Ser. No. 340,715 filed Apr. 20, 1989 now abandoned.

BACKGROUND OF THE INVENTION

This invention relates to an improved process for beneficiating phosphate rock. More particularly, this invention relates to an improved method for concentrating (extracting) phosphate minerals from their ores in the flotation process.

One source of the phosphate mineral is a substance known as phosphate rock. Phosphate rock is found in significant concentrations in mid-Florida area sedimentary deposits. Within the phosphate mining industry the rock is generally surface mined by the use of draglines, dredges or other apparatus.

The phosphate matrix, also known as phosphate ore, that is mined is slurried with high pressure water and pumped to a processing plant where phosphate is extracted. The processing plant separates clays, silica and other diluents from the phosphate rock in order to produce various sizes and grades of salable phosphate rock product. Typically an operation would produce a pebble product, an intermediate product and a flotation concentrate. The size distributions and grades of these products are to a degree phosphate ore and processing facility specific with the following descriptions representing a typical operation. When the phosphate ore slurry reaches the plant it is treated in a washing step where particles larger than approximately 14 Tyler mesh are separated from the remainder of the phosphate ore. This size fraction is typically known as phosphate pebble and has a range of bone phosphate of lime (BPL) values of about 50 to 70.

The material smaller than 14 Tyler mesh is advanced to further sizing processes where clays and other minerals smaller than approximately 200 Tyler mesh are removed and transferred to waste slimes settling areas. Particles larger than 20 Tyler mesh are retained as an intermediate product which typically ranges from 40 to 65 BPL. The methods used to achieve the separation of this intermediate product vary widely and include assorted hydrosizers, spiral classifiers, screens, other mineral sizing techniques and various combinations of these techniques as required by ore characteristics and individual site preference.

The remaining size fraction represents a fairly low grade material which is not usually salable without additional concentration/upgrading. The fraction that falls between 20 and 200 Tyler mesh represents a substantial percentage of the phosphatic values in the ore. A typical range of about 5 to 40 BPL can be attributed to this size fraction depending on geography and specific matrix characteristics.

This size fraction is typically referred to as flotation feed and is usually concentrated by froth flotation. Typically this is accomplished by an initial rougher flotation step where all recoverable phosphate and a fairly high quantity of silica and other diluents are floated, followed by one or more cleaner flotation step(s) to remove the silica and other diluents from the phosphate concentrate. These flotation step(s) produce a phosphate concentrate product with enhanced grade and salability. Typical rougher flotation concentrates range from 50 to 65 BPL with cleaner flotation concentrates ranging from 65 to 75 BPL.

In the flotation process the flotation feed might be subjected to further sizing operations prior to rougher flotation. These sizing operations vary widely in scope and intent with the flotation process actually beginning when the flotation feed is forwarded to conditioning vessels where reagents are added and the mixture agitated.

In the conditioning step flotation feed is brought into contact with various organic substances including fuel oils, tall oil fatty acids and combinations thereof. These reagents are added in an environment with a controlled pH, which allows the organic components to preferentially adhere to the phosphate containing components, while not preferentially coating silica and other such components. The objective here is to make the phosphate mineral portion hydrophobic so that the phosphate rock component will be floated once the conditioned and reagentized feed enters the flotation cell(s). In the flotation cell(s) the reagentized phosphate is attached to air bubbles in an agitated pulp which then floats off in an overstream froth containing phosphate minerals, some sand and other diluents. Unrecovered phosphate, sand and other minerals are rejected as the unfloated (sink) portion to the rougher tailings stream.

The phosphate which is floated, the rougher concentrate, can be upgraded further to enhance the phosphate concentration. Most operations advance the rougher concentrate to a de-oiling step where an acid, such as sulfuric acid, is added prior to rinsing with clear water to remove the organic substances added in the rougher flotation step. Once de-oiled the rougher concentrate is refloated with an amine and an organic hydrocarbon such as kerosene in a cleaner floation step where silica and other diluents are floated and discarded to the tailings stream as a waste product. The phosphate concentrate is recovered from the sink portion of the flotation cell and transported to storage for eventual sale.

The silica, unrecovered phosphate and other minerals rejected from the flotation process are transported to a tailings waste storage area where these tailings are typically used as fill for land reclamation.

The phosphate extraction/concentration process typically uses large quantities of water which is circulated in a series of settling areas, tailings areas and various holding ponds for reuse prior to the discharge of some water. The quality of this discharged water is of great importance and concern. It should not be in a form that would be harmful to the environment.

In the conditioning step of the rougher flotation process ammonia, sodium hydroxide, ammonium hydroxide or mixtures of these substances are typically used to closely control the pH level in the conditioning vessels.

In U.S. Pat. No. 2,293,640 it is disclosed that a thick aqueous pulp of phosphate ore which consists of about 70% solids is agitated in a solution which consists of fish oil fatty acid, fuel oil and caustic soda. The caustic soda would maintain the pH of this solution in the basic range.

In U.S. Pat. Nos. 4,747,941 and 4,642,181 there is disclosed a method of decreasing the magnesium content of a phosphate ore by means of flotation in conjunction with the use of particular inorganic promoters. The inorganic promoters that are utilized include ammonia and/or sodium carbonate. The beneficiation step that is set forth in these patents is quite different from that which is the subject of the present invention. In the processes disclosed in these patents the ore material is sized and is then mixed with the promoter materials, the fatty acid, fluosilisic acid and a frothing agent. The result is that the phosphate ore particles are made hydrophilic while the fraction of the ore containing the carbonate sand and magnesium impurities is made hydrophobic. Air is introduced into the vessel to form a froth. The froth that is formed produces an overstream of the hydrophobic carbonate, sand and magnesium impurities which are removed from the overstream of the vessel. This is in contrast to the present process wherein the phosphate mineral is made hydrophobic and is removed in the overstream. After the completion of the carbonate float an amine is added as a silica collector, and the slurry is again aerated. Upon being aerated the silica materials float to the surface and are removed in an overstream. The remaining substance in the tank is then primarily phosphate. Interestingly, this patent discloses that sodium carbonate is an inhibitor with regard to the flotation of the phosphate component rather than a promoter of the floation of the phosphate component.

U.S. Pat. No. 4,556,545 discloses a method for conditioning phosphate ores. In this process a hydrocarbon oil, such as fuel oil, is introduced into a pre-stabilization step upstream of the conditioning step. In the pre-stabilization step the hydrocarbon oil is combined with water containing a fatty acid and an alkaline agent under vigorous mixing to produce a stable homogeneous emulsion. The emulsion is then introduced into the conditioning step where it is contacted with phosphate ore. The product of the conditioning step is then conducted to a conventional, downstream floatation step of the operation. The function of the alkaline agent is to saponify the fatty acid. In this regard all alkaline agents are considered to be equivalents. In the preferred embodiment in the examples ammonium hydroxide is used. There is no disclosure with regard to the alkaline agent except to saponify the fatty acid.

Many sources of phosphate ores contain carbonates as one of the contaminants. Many of these are found in the western part of the United States. Thus, in the processing of the phosphate rock material, the carbonate component must be removed. This is accomplished through the use of various flotation techniques. One such technique is disclosed in U.S. Pat. No. 4,486,301. This patent discloses an ore flotation process where the phosphate ore which contains carbonate mineral impurities is subject to froth flotation in the presence of modifying agents such as alkyl phosphoric acids and hydrofluoric acid. The collector substance consists of fatty acids. In this patent, in the separation of the phosphate values from carbonate contaminants, the carbonate is a component of the basic mineral to be removed at an early stage. It is the intent of these processes to separate the carbonate component from the mineral and to thereby leave the phosphate component. These processes do not use sodium carbonate in the rougher stage for the enhanced flotation of the phosphate rock values. Rather, any carbonate that is present is considered to be a contaminant and something that must be removed.

Another operation that is performed on phosphate ores is that of defluorination. Various alkaline materials such as soda ash, sodium sulphate, sodium nitrate, sodium formate, sodium chloride, potassium carbonate, and potassium sulfate have been utilized for the defluorination of phosphate materials. In U.S. Pat. No. 3,058,804 there is disclosed a process for producing defluorinated calcium phosphate. In this process a phosphate rock is mixed with a sodium acid phosphate with the mixture having a moisture content of between about 5% and 15% by weight. These materials are intimately mixed. An alkali metal salt, such as sodium carbonate, is then added. This alkali metal salt is thoroughly mixed with the other components at about 1250° C. to 1300° C. whereby the fluorine content of the calcium phosphate is significantly reduced. In this instance the function of the alkali metal salt, such as sodium carbonte, is to interact with the fluorinated calcium phosphate and to remove most, if not all, of the fluorine content thereof. A related process is disclosed in U.S. Pat. No. 4,152,398 where a defluorinated phosphate is produced that can be used as an animal feed additive.

U.S. Pat. No. 3,078,156 discloses another defluorination process. In this process a phosphoric acid solution is added to a mixture of phosphate rock, Glaubers salt or soda ash and thoroughly mixed. In the following step this mixture is heated to an elevated temperature so as to remove the fluorine content. A further related patent reference with regard to defluorinating phosphate rock is U.S. Pat. No. 3,364,008. In this patent there is disclosed a process whereby a defluorinating agent such as soda ash, or lime is added to phosphoric acid and phosphate rock. The three components are thoroughly mixed and optionally dried and screened. After the optional drying and screening steps, the mixture is fed to a fluid bed reactor. This fluid bed reactor is maintained at a temperature of about 1000° F. to 1300° F. In this reactor fluorine gas is taken off the top of the reactor along with other gases and an agglomerated and defluorinated phosphate product is taken off at the bottom of the reactor.

U.S. Pat. No. 2,839,377 describes another technique with regard to the defluorination of phosphate rock. In this process sodium carbonate is mixed with an aqueous solution of phosphoric acid to produce the treating reagent. The treating reagent is then fed to a rotary kiln along with phosphate rock. During calcination the fluorine content of the phosphate rock is significantly reduced. The result is a calcium phosphate having a very low fluorine content. Another related process is disclosed in East German Patent 200-081-A. In this patent there is disclosed that sodium carbonate and phosphoric acid are mixed with an apatitic phosphate rock. This mixture is then calcined in a rotary tube furnace. The net result is a defluorinated phosphate which can be utilized as an animal fodder additive.

In U.S. Pat. No. 4,609,535 there is disclosed a process for leaching the phosphate values from iron and aluminum phosphates using an alkali metal carbonate solution. The alkali metal carbonate solution contacts the iron and aluminum phosphates and removes the phosphate content. The leachate can then be used to make fertilizers.

U.S. Pat. No. 3,032,189 lists a series of basic inorganic materials for use to adjust the pH of a flotation slurry above 7. These basic organic materials include caustic soda, caustic potash, alkali bicarbonates, such as $KHCO_3$ and $NaHCO_3$, and alkali carbonates, such as $Na_2CO_3$, $K_2CO_3$, and $CaCO_3$. The patent teaches the use of these materials in a pH range from about 7.5 to about 9.5 and preferably between about 8 and about 9. This patent is directed to the processing of phosphatic ores which contain relatively high concentrations of iron and aluminum, such as those found in Tennessee and West Africa, which cannot be concentrated economically by conventional ore dressing techniques.

None of the patents covering the processing of phosphate rock cited hereinabove are entirely adequate for the processing of phosphate ores from the sedimentary phosphate rock deposits of central Florida. As already noted, some of the processes are undesirable because of their high temperature requirements, some are specifically designed for the removal of magnesium and calcium carbonates, and while others address the beneficiation of phosphate deposits high in specific impurities, such as iron and aluminum.

It is therefore an objective of this invention to provide an improved process for the beneficiation of central Florida phosphate rock.

It is another object of this invention to provide an improved reagent and pH range for the conditioning of flotation feed slurry prior to rougher flotation of phosphate rock.

It is still another object of this invention to provide a flotation system for the processing of central Florida phosphate rock which yields higher phosphate recoveries and generates concentrates with a higher phosphate content than heretofore possible.

It has been found that by using sodium carbonate, the technical grade of which is commercially known as soda ash, as the pH modifier in lieu of those pH modifiers typically used in the prior processes, recovery of phosphate in the flotation process is improved, the grade, that is the phosphate concentration of the rougher flotation product is improved and the quality of the discharge water is improved.

SUMMARY OF THE INVENTION

The present invention is directed to the use of sodium carbonate as a component of the first stage rougher flotation process for the separation of phosphate rock from various waste materials. The process of the invention is particularly suitable for Florida phosphate ores.

In current commercial practice, the rougher flotation conditioning, pH control step is typically achieved with ammonia as the pH modifier. Sodium hydroxide, ammonium hydroxide, calcium carbonate and other similar reagents have been cited in the patent literature for use in phosphate flotation. The use of sodium carbonate has also been included in the lists of possible pH modifiers when used at pH below 9.5. It has now been found that sodium carbonate, when used in the pH range of 9.6 to 10.5 is uniquely superior to other reagents typically used as pH modifiers. Further, the rougher concentrate produced with sodium carbonate as the pH modifier yields improved recovery of the phosphate mineral from the flotation feed in the rougher flotation operation. Sodium carbonate produces a deeper, stronger froth with a greater life than is found with ammonia or the other typical pH modifiers. The sodium carbonate is also used as a water softening agent which serves to enhance selective flotation of the phosphate.

The rougher concentrate produced with sodium carbonate as the conditioner and pH modifier has a higher concentration of the phosphate mineral than would be found with ammonia or other typical pH modifier. This results in a higher grade feed to the later cleaner flotation step(s) and allows better performance and/or higher concentrate production in a fixed system.

Using sodium carbonate in lieu of ammonia also has benefits in the quality of the water circulated, reused and eventually discharged off property. Ammonia has a nitrogen component which can have a negative environmental impact, promoting algar growth and/or bacterial activity in ground and surface waters. Replacing ammonia with sodium carbonate as first stage rougher flotation pH modifier eliminates that nitrogen source from the beneficiation process and the related water flows/discharges.

Operating safety is also enhanced with sodium carbonate. Anhydrous ammonia is stored in pressure vessels and represents a potential personnel hazard should an upset occur. In addition ammonia usage during normal operation in the rougher flotation conditioning step gives off a pungent odor which could be unsafe in enclosed, poorly ventilated, locations. In contrast, sodium carbonate is odorless and does not represent the bulk storage hazard that anhydrous ammonia does.

DETAILED DESCRIPTION OF THE INVENTION

Figure 1:
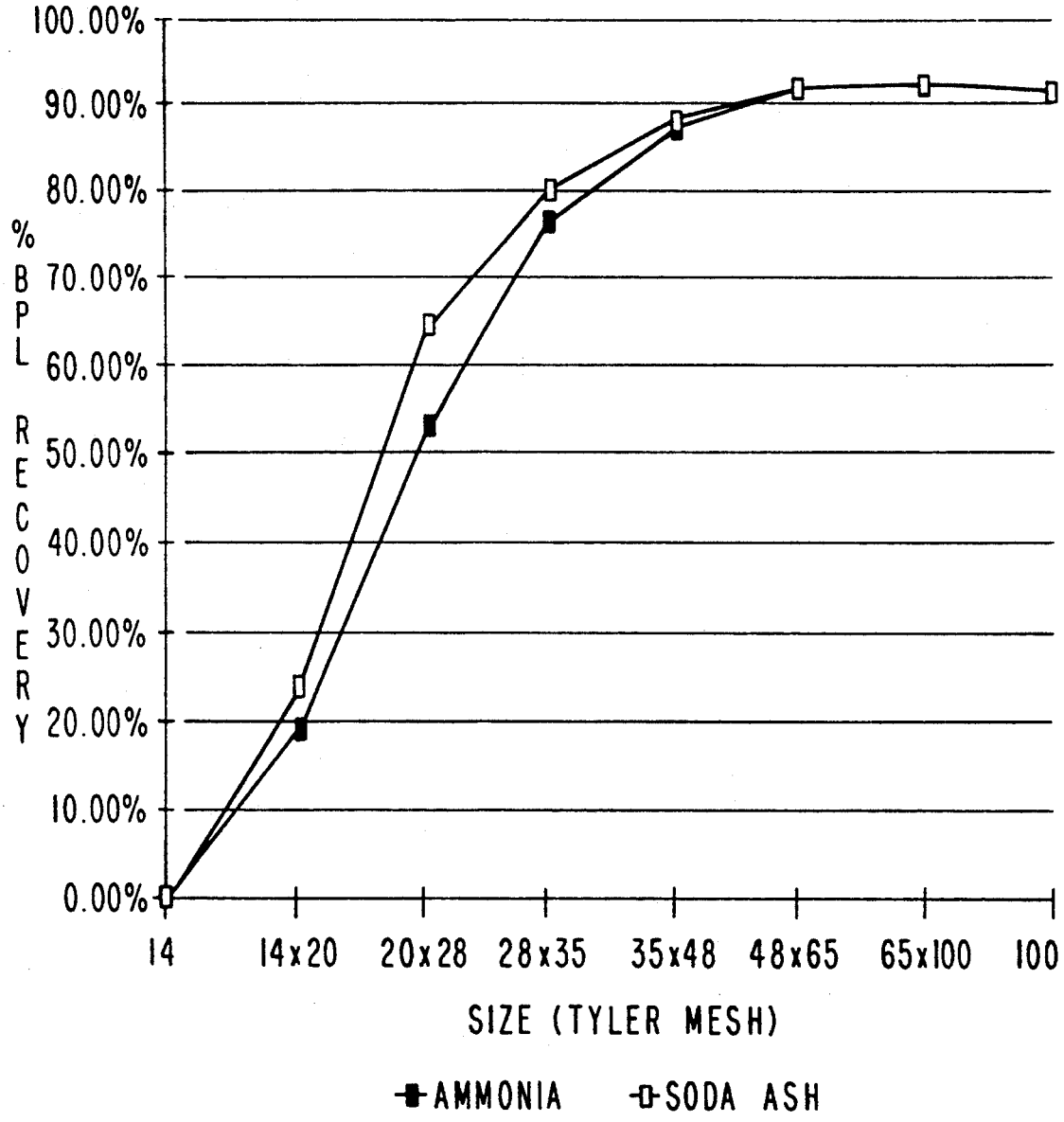
FIG. 1 is a graph showing the percent BPL recovery versus the particle size of the phosphate rock for ammonia and for soda ash.

As previously discussed, the phosphate mining and processing operation can typically produce pebble and intermediate products which are separated from the ore using various sizing operations. Another product is a phosphate concentrate which typically ranges in BPL value from about 65 to 75 and is produced by concentrating flotation feed in a flotation process. Once phosphate pebble and intermediate products are separated from those fine components which are smaller than about 200 Tyler mesh, a fairly low grade material remains which can be concentrated by flotation. This material, typically known as flotation feed, ranges from about 20 to 200 Tyler mesh and represents a substantial portion of the ore phosphate values and typically runs between 5 and 40 BPL prior to flotation. Once processed in the flotation circuit(s) concentrates ranging from about 50 to 75 BPL can be produced depending on flotation feed characteristics and the flotation process used.

The process of the present invention is particularly suitable for Florida phosphate ores. In the processing of phosphate ores, the ore is typically separated according to size, slurried with water and screened. The −20+200 Tyler mesh fraction of the ore is then subjected to flotation. The chemical composition of Florida ores differs from other ores such that after the initial screening, the Florida ore contains lower percentage of BPL and significantly higher percentages of insolubles, such as sand, and significantly lower percentages of iron and aluminum compounds, compared to other ores such as the high aluminum and iron ores of Tennessee. These differences in the composition of Florida ores causes the ores to respond differently during flotation from other ores. For example, a typical Tennessee ore after screening will contain about 54.6% BPL, 26.3% insolubles, 5.4% iron oxide, 1.3% aluminum oxide. In contrast, a Florida ore typically contains 15.0% BPL, 72% insolubles (sand), 0.45% iron oxide, and about 0.50% aluminum oxide.

The first stage of the flotation process typically involves a rougher flotation process. This first flotation stage can be conducted on the full flotation feed size distribution of the aqueous phosphate ore slurry or this size fraction can first be separated into two or more particle size cuts. Regardless of how performed, there will be an overall increase in phosphate ore recovery when sodium carbonate is used for pH control rather than sodium hydroxide, ammonia or ammonium hydroxide.

In this first stage, the flotation feed is fed into conditioning vessels where it is treated with one or more organic components and with a pH modifier. Typical organic substances that are utilized comprise a fatty acid, such as tall oil, and a hydrocarbon oil, such as fuel oil. In this step the organic substances will coat the surface of the phosphate particles to make the phosphate hydrophobic. Once the phosphate is hydrophobic, it will be floated to the surface of the flotation cell(s) and be taken up by the flotation froth. Once taken up by the flotation froth, the phosphate ore with minor amounts of silica and other diluents, is removed from the flotation vessel in the froth.

The present invention is directed to those improvements which result when sodium carbonate, also known as soda ash, is used as the pH modifier to maintain the pH in the range of about 9.6 to 10.5 and preferably pH 9.8 to 10.5 during conditioning. In the conditioning vessels the components of the flotation feed are thoroughly mixed with the organic components which are comprised of a fatty acid, such as tall oil, and hydrocarbon oils, such as fuel oils, to provide for the hydrophobic coating on the phosphate ore particles.

The ratio of fatty acid, such as tall oil, to hydrocarbon oil, such as fuel oil, will range from 40% fatty acid and 60% fuel oil to 80% fatty acid and 20% fuel oil. The ratios are adjusted depending on the composition that will best float the phosphate ore. This will be dependent on the ore composition and on the ore particle size.

The phosphate rock slurry which has been so treated in the conditioning vessels is then continuously flowed to the first stage flotation cell(s) containing additional water. Air is added to the flotation cells through an agitated air sparging system to form a froth. Due to the coating of the phosphate component, this phosphate component is hydrophobic and will float in the froth of the flotation cell(s). Silica and other diluents which are not rendered hydrophobic will sink to the bottom of the flotation cell(s) and be discharged to waste as rougher flotation tails. The phosphate ore which is taken from the flotation cell(s) as a froth product will have a BPL in the range of about 50 to 65, i.e. this rougher flotation stage upgrades the flotation feed from 5 to 40 BPL to a rougher concentrate material of 50 to 65 BPL.

It has advantageously been found that the rougher flotation stage can be more effectively conducted if an alkali carbonate is utilized to adjust the pH to about 9.6 to 10.5 and preferably about 9.8 to 10.5. Sodium carbonate is present as a general component of the flotation medium, rather then sodium hydroxide, sodium bicarbonate, calcium carbonate, ammonia, or ammonium hydroxide or other similar reagents. The use of sodium carbonate yields several unexpected advantages. In a preferred embodiment of the invention, sodium carbonate is added in an amount to result in a pH of at least 9.6 and preferably a pH of at least 9.8.

It has been discovered that when sodium carbonate is utilized in an rougher flotation conditioning step, there is an enhanced recovery of phosphate values. In this first stage of flotation feed processing also referred to as rougher flotation, the flotation feed is concentrated with regaurd to its phosphate content. The use of sodium carbonate as a conditioning pH modifier also results in a highly percentage of phosphate recovered in the rougher flotation stage for the larger size particles in the ores.

The use of sodium carbonate in the flotation of phosphate ores and in particular Florida phosphate ore is believed to function as a water softening agent to enhance the selective flotation of the phosphate. The flotation enhancing characteristics of sodium carbonate is particularly beneficial in Florida ores.

The sodium carbonate can be added to the rougher flotation conditioning step either as a solid or as an aqueous solution. It is usually added as an aqueous solution. a saturated aqueous solution of soda ash contains about 33 percent by weight soda ash. The sodium carbonate, can be used in a solution in a concentration of less than a sturated solution, however, it is preferred that it be used in a concentration of less than about 20 pecent by weight, and most preferably at a concentration of less than about 10 percent by weight. A useful concentration is between about 6 to 7 percent by weight. The use of lower concentrations requires the use of larger volumes of water, but provides for better process control.

FIG. 1 demonstrates the recovery improvement obtained by using sodium carbonate in the rougher flotation conditioning step in lieu of ammonia as the pH modifier.

Besides being able to effectively modify the pH of the flotation medium, the soda ash provides for the more selective recovery of phosphate in the rougher flotation froth. A lower percentage of silica and other diluents are floated in the rougher flotation stage when sodium carbonate is used as the conditioning pH modifier. It appears that soda ash floats very little of the contaminating silica content of the ore. This is in contrast to ammonia which floats a much higher quantity of silica and other diluents. This in turn puts the overall flotation process on a different response curve and benefits the complete flotation process.

Figure 2:
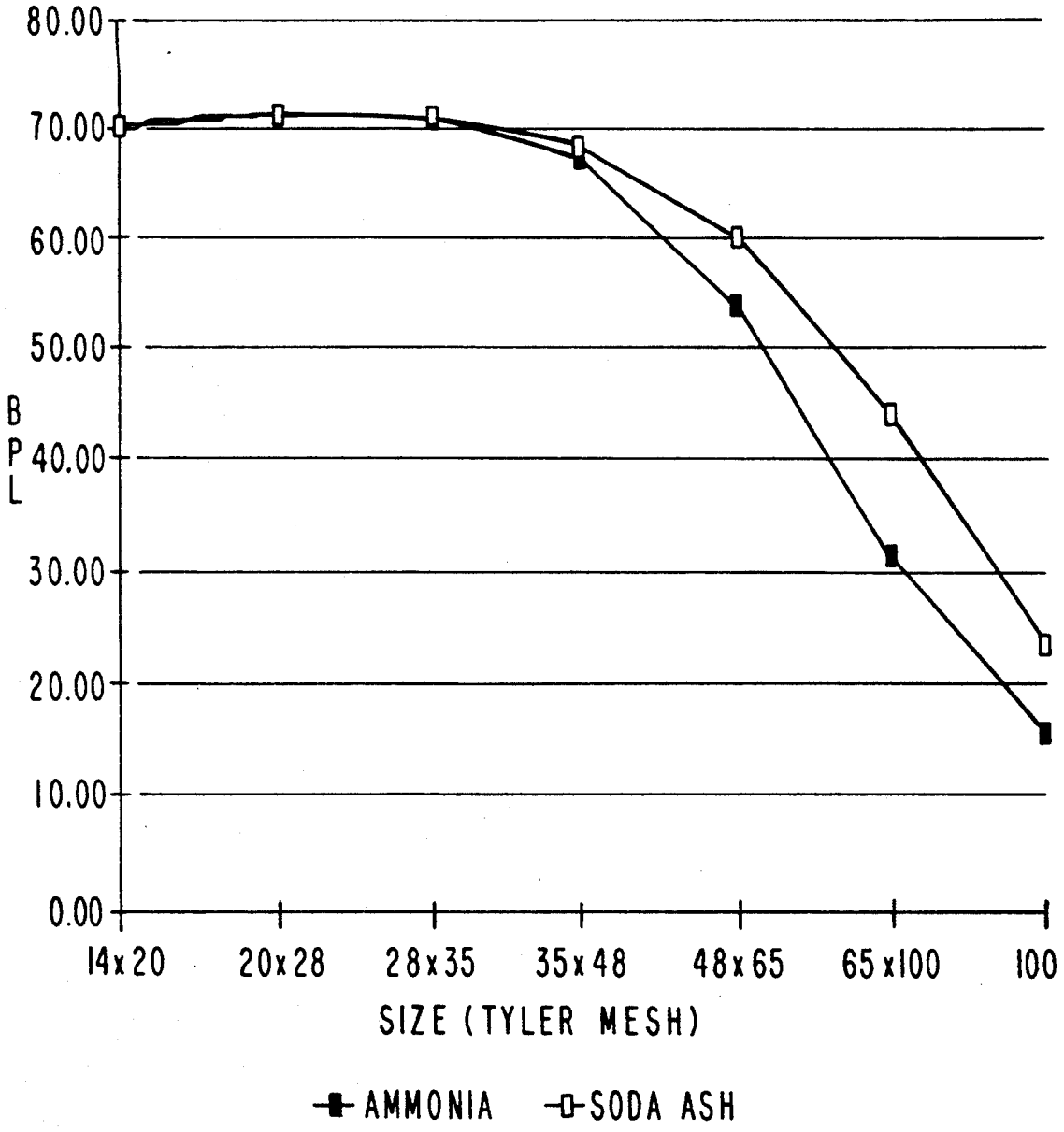
FIG. 2 is a graph of the BPL of the recovered phosphate rock versus the particle size of the phosphate rock for ammonia and for soda ash.

FIG. 2 demonstrates the improved selectivity, that is, the improved concentration of phosphate with a lowered percentage of silica and other diluents, found when sodium carbonate is used as the pH modifier in the rougher flotation conditioning step. It is seen that for almost any particle size range of rougher concentrate the BPL will be greater when soda ash is used rather than ammonia.

The efficiency of flotation vessels is dependent on the rate that phosphate values are taken up by the froth and removed in an overstream. Significantly improved flotation efficiencies are attained when sodium carbonate is used in a pH range of 9.6 to 10.5 as the rougher flotation conditioning pH modifier. The reason for the improved flotation efficiency associated with the use of sodium carbonate in the pH range of 9.6 to 10.5 is not completely understood, but may be related to the fact that the water flotation medium is softened which provides the flotation vessels with the ability to produce a more sudsy and stable froth float. This more stable froth float can carry a greater amount of phosphate ore. The feed rate can thus be adjusted for maximum throughput.

There is a greater throughput when sodium carbonate is used as the pH control agent than when ammonia, sodium hydroxide or other similar reagents are used.

A typical phosphate beneficiating facility consumes large quantities of ammonia or other pH modifiers in the rougher flotation stage. Consequently large quantities of ammonia, with the attendant nitrogen content, are added to the water flows of the phosphate mining/processing operation. This nitrogen represents a potential environmental problem when added to water. It can impact the growth water plants, algae and bacterial activity in surface and ground waters, and could result in an unacceptably low quality water. When sodium carbonate replaces ammonia, that nitrogen source is avoided and a potential negative environmental impact is avoided.

Anhydrous ammonia, when used as the rougher flotation conditioning pH modifier, requires bulk storage in large pressure vessels. These storage vessels represent a significant hazard to nearby personnel should an upset occur. In addition, ammonia's pungent odor can present an unsafe situation in an enclosed area with inadequate ventilation. Since sodium carbonate requires no bulk storage of a pressurized hazardous liquid, and is odorless, it represents an alternate reagent with several preferred safety features.

Prior to the next flotation stage which is traditionally practiced, the organic material is stripped from the rougher concentrate. This de-oiling step is accomplished by contacting the phosphate ore with an acid, such as sulfuric acid. The rougher concentrate slurry is then washed with water, and fed to the second stage of flotation which is comprised of a cleaner flotation stage where silica and other diluents are removed and separated from the rougher concentrate.

In the cleaner flotation circuit the rougher concentrate is contacted in conditioning vessels with an amine. Other substances may also be present including light fuel oils, such as kerosene, and fatty acids such as tall oil. In this second flotation stage the silica and other diluents are floated to the top for removal as a waste froth product. This froth is discarded to tails as a waste product. The unfloated, or sink, portion is removed from the bottom of the flotation cell(s) as a final phosphate concentrate which will range from about 65 to 75 BPL. This phosphate component of the flotation feed can now be used for the production of phosphoric acid.

In the production of phosphoric acid this phosphate rock is reacted with sulfuric acid as the first step in making phosphoric acid. This and the subsequent steps in the production of phosphoric acid are conventional steps. The prime discovery that has been made is the advantageous use of sodium carbonate in the first stage rougher flotation conditioning step in upgrading/concentrating the flotation feed to an improved rougher phosphate concentrate.

The sodium carbonate effectively controls the pH. In addition the BPL of the phosphate values in the rougher concentrate produced in rougher flotation demonstrate improved recovery of the phosphate overall, as well a 15 to 30% improvement in the rougher concentrate phosphate concentration (i.e., a lower quantity of silica and other diluents are present in the first stage rougher concentrate). In addition, the replacement of ammonia with sodium carbonate has environmental advantages since a major source of nitrogen has been deleted from the water circulating and discharge system. Further, sodium carbonate represents a safer reagent handling situation than that found with anhydrous ammonia.

The present invention will now be discussed in further detail with reference to the following examples. In Example 1 the first of two parallel flotation circuits is used. In Example 2 the second of the two parallel flotation circuits is used.

EXAMPLE 1

This example sets forth a comparison in the rougher flotation feed conditioning section of a first circuit of a phosphate beneficiating plant between the use of ammonia for pH control and the use of soda ash for pH control. In this example the conditioning is performed using a multiple number of vertical conditioning tanks. The flotation feed consists of an intermediate cut of the input phosphate flotation feed. The particle sizes and associated recoveries and rougher concentrate BPL's are set forth in Table 1. The flotation feed is fed to the rougher feed cyclones and then to dewatering cones. The dewatering cones decrease the water content of the rougher feed which varies from about 25 to 35 percent water by weight. This feed is then flowed to rougher conditioners where it is mixed with tall oil and No. 5 fuel oil. The contents of these materials are adjusted for each run to provide for a maximum flotation of the phosphate ore.

Depending on the run either an aqueous solution of ammonia or soda ash is added as the alkaline agent in the conditioners. Soda ash is used in about 10% by weight solution and ammonia in about a 5% by weight solution. The soda ash is added to produce a pH of about 9 to 10.5. The exact pH is adjusted in each run for maximum phosphate ore flotation. The conditioned phosphate rock is then fed to the rougher flotation cells. In these cells a concentrated phosphate rock is taken off as an overstream. The following Table 1 sets forth the average recovery on a BPL basis for a multiple number of runs using ammonia as the pH control agent and using soda ash as the pH control agent.

TABLE 1

| Particle | % BPL Recovery | | Rougher Concentrate BPL | |
|---|---|---|---|---|
| Size* | Ammonia | Soda Ash | Ammonia | Soda Ash |
| 14 | 0.00 | 0.00 | 0.00 | 0.00 |
| 20 | 22.26 | 25.10 | 70.53 | 70.19 |
| 28 | 56.34 | 66.38 | 71.30 | 70.96 |
| 35 | 78.4 | 81.48 | 70.92 | 71.07 |
| 48 | 87.99 | 88.36 | 67.72 | 68.59 |
| 65 | 92.37 | 91.98 | 55.10 | 60.96 |
| 100 | 92.88 | 92.50 | 32.56 | 45.33 |
| −100 | 92.18 | 91.81 | 16.18 | 23.92 |

*Tyler Mesh

This example illustrates that at the larger phosphate ore particle sizes, soda ash provides for a greater recovery of phosphate ore than ammonia. As the particle size of the ore decreases it is easier to float the ore and thus both ammonia and soda ash are of similar effectiveness.

EXAMPLE 2

This example sets forth a comparison in the rougher flotation feed conditioning section of a second circuit of a phosphate beneficiating plant of the use of ammonia for pH control and the use of soda ash for pH control. The flotation feed consists of an intermediate cut of the input phosphate flotation feed. The particle sizes with associated recoveries and rougher concentrate BPL's are set forth in Table 2. The flotation feed is fed to rougher feed cyclones and then to dewatering cones.

The water content after the dewatering cones varies from about 25 to 35 percent by weight. The dewatered phosphate rock is then fed to horizontal conditioning drums where it is contacted with tall oil and No. 5 fuel oil and either ammonia or soda ash. The contents of tall oil and fuel oil are adjusted for each run to maximize the flotation of the phosphate ore. Depending on the run either an aqueous solution of ammonia or soda ash is added to produce a pH of about 9 to 10.5. These have the concentrations as in Example 1. The exact pH is set to maximize the flotation of phosphate ore. The conditioned phosphate rock is then fed to the rougher flotation cells. In these cells a concentrated phosphate rock is taken off as an overstream. The following Table 2 shows the recovery on a BPL basis on a multiple number of runs using ammonia as a pH control agent and using soda ash as a pH control agent.

TABLE 2

| Particle | % BPL Recovery | | Rougher Concentrate BPL | |
|---|---|---|---|---|
| Size* | Ammonia | Soda Ash | Ammonia | Soda Ash |
| 14 | 0.00 | 0.00 | 0.00 | 0.00 |
| 20 | 0.00 | 15.63 | 0.00 | 70.87 |
| 28 | 26.76 | 54.22 | 70.00 | 70.40 |
| 25 | 60.34 | 75.55 | 70.61 | 70.96 |
| 48 | 80.95 | 87.26 | 64.39 | 66.09 |
| 65 | 87.69 | 92.82 | 43.36 | 54.15 |
| 100 | 87.59 | 91.98 | 20.85 | 34.60 |
| −100 | 89.73 | 90.80 | 12.39 | 19.40 |

*Tyler Mesh Series

This Table 2, like Table 1, shows that there is a greater recovery of phosphate ore when soda ash is used rather than when ammonia is used.

EXAMPLE 3

This example sets forth the overall improvement in the use of soda ash over ammonia in the rougher flotation feed conditioning step in a phosphate beneficiating plant. The data from Table 1 of Example 1 and Table 2 of Example 2 is combined. Example 1 and Example 2 differ primarily in the conditioning technique. The combined data is set out in Table 3.

TABLE 3

| Particle | % BPL Recovery | | Rougher Concentrate BPL | |
|---|---|---|---|---|
| Size* | Ammonia | Soda Ash | Ammonia | Soda Ash |
| 14 | 0.00 | 0.00 | 0.00 | 0.00 |
| 20 | 19.25 | 23.32 | 70.53 | 70.26 |
| 28 | 52.72 | 64.08 | 71.17 | 70.90 |
| 35 | 76.60 | 80.19 | 70.89 | 71.06 |
| 48 | 87.03 | 88.04 | 67.38 | 68.34 |
| 65 | 91.80 | 92.08 | 53.91 | 60.27 |
| 100 | 92.29 | 92.44 | 31.38 | 44.25 |
| −100 | 91.71 | 91.60 | 15.80 | 23.46 |

*Tyler Mesh Series

FIGS. 1 and 2 set forth the data in Table 3 in graph form. The figures vividly show the improvement in the recovery of phosphate values when soda ash is used in place of ammonia as the conditioning pH control agent. This is particularly evident for the larger particle size ore particles which are more difficult to float and to recover in the froth overstream.

EXAMPLE 4

Figure 3:
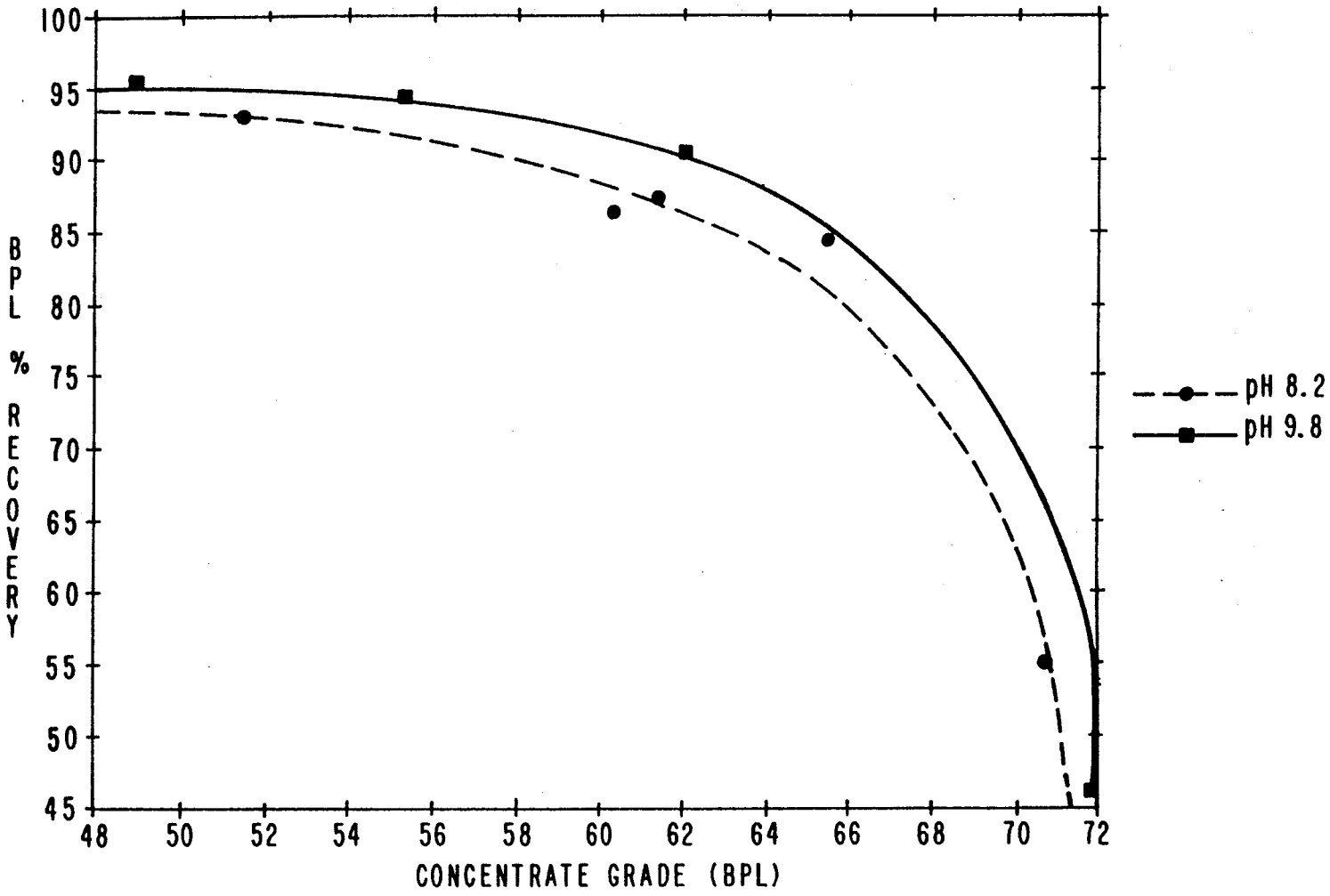
FIG. 3 is a graph of the percent BPL recovery versus the concentrate grade of phosphate rock using sodium carbonate (soda ash) in pH 8.2 and pH 9.8.

This example sets forth a comparison between the use of sodium carbonate at a pH of 9.8 versus the use of sodium carbonate at a pH of 8.2 in the rougher flotation feed conditioning section of a phosphate beneficiating plant. The phosphate flotation feed was fed to a conditioning vessel where it was contacted with tall oil, No. 5 fuel oil and sodium carbonate. The sodium carbonate was added as a 7% by weight solution so as to attain a pH of 8.2 and 9.8, respectively, in two consecutive series of runs. The conditioned phosphate rock slurry was then fed to the rougher flotation cell. The phosphate recoveries and the concentrate grade values obtained in these two series of tests are summarized in Table 4 below. The data are also graphically represented in FIG. 3. The phosphate ore as introduced to the flotation vessel contained about 14.9% BPL, about 71.8% sand, about 0.45% iron oxide and about 0.48% aluminum oxide. This example illustrates that significant improvements in phosphate recovery were achieved at the higher pH of 9.8, as compared to the recoveries obtained at a pH of 8.2.

TABLE 4

Effect of pH On Grade and Recovery of Phosphate Using Sodium Carbonate

| pH 8.2 | | pH 9.8 | |
|---|---|---|---|
| Grade (BPL) | Recovery (%) | Grade (BPL) | Recovery (%) |
| 70.7 | 55.1 | 71.9 | 46.3 |
| 65.5 | 84.4 | 62.1 | 90.6 |
| 61.5 | 87.4 | 55.4 | 94.4 |
| 60.4 | 86.4 | 49.0 | 95.4 |
| 51.5 | 93.0 | | |

EXAMPLE 5

This example sets forth the effects of using sodium bicarbonate, calcium hydroxide, or calcium carbonate as pH control agents in the rougher flotation feed conditioning section of a phosphate beneficiating plant processing central Florida flotation feed. The flotation feed was fed to rougher conditioners where it was mixed with tall oil and No. 5 fuel oil. When calcium hydroxide was used to adjust the pH to 9.8, no flotation concentrate was obtained during subsequent flotation. The use of sodium bicarbonate or calcium carbonate, failed to result in achieving the desire pH range of 9.6 to 10.5. Consequently, none of these three reagents was deemed suitable for the flotation of Florida phosphates in accordance with the process of this invention.

The above examples demonstrate that the use of sodium carbonate at a pH of about 9.6 to 10.5 result in enhanced phosphate recovery. The data further demonstrate a particular advantage of using sodium carbonate as a flotation enhancer for Florida phosphate ore.

What we claimed is:

1. A process for the selective separation of phosphate values from Florida phosphate ore containing silica, comprising a) forming an aqueous slurry of sized phosphate ore flotation feed;

b) admixing at least one organic liquid to make the surface of the phosphate ore hydrophobic;

c) admixing a flotation enhancer consisting essentially of sodium carbonate with the aqueous slurry to adjust the pH of the slurry to a value between about 9.8 and about 10.5 and to increase phosphate recovery without silica contamination in a subsequent froth flotation stage;

d) subjecting the aqueous slurry to froth flotation at a pH between about 9.8 and about 10.5, and in the absence of any phospho-organic depressants for said silica, to produce a phosphate-rich float and a silica-rich underflow;

e) recovering a phosphate float concentrate having a low silica content.

2. A process as in claim 1 wherein said organic liquid consists of at least one fatty acid and at least one oil which coat the phosphate ore particles causing said particles to float and to be removed as an upper froth overflow stream and said sodium carbonate is added as an aqueous solution containing less than about 20 percent by weight sodium carbonate.

3. A process as in claim 2 wherein said phosphate float concentrate is are treated with a mineral acid to remove the organic liquid.

4. A process as in claim 3 wherein said mineral acid is sulfuric acid.

5. A process as in claim 1 wherein said at least one organic liquid is selected from the group consisting of fuel oils, fatty acids and mixtures thereof.

6. A process as in claim 1 wherein said at least one organic liquid is selected from the group consisting of tall oil, fuel oils and mixtures thereof.

7. A process as in claim 1 wherein the sized phosphate ore is in a size range of about 20 to about 200 Tyler mesh.

8. A process as in claim 1 wherein the sized phosphate ore is processed in at least two particle size ranges, with each size range being subjected to the sequence of processing steps defined in claim 1.

9. An improved process for the selective flotation of phosphate values from an aqueous slurry of Florida phosphate ore containing silica, wherein the phosphate ore has an average particle size of about 20 to about 200 Tyler mesh, the process including the steps of admixing an organic liquid to make the surface of the phosphate ore hydrophobic, adding a water softening, flotation enhancer and adjusting the pH of the slurry to pH about 9.8 to pH 10.5, subjecting the slurry to a froth flotation step, in the absence of any phospho-organic depressants for said silica, to selectively float the phosphate values without the silica and recovering the phosphate values from the froth wherein the water softening flotation enhancer consists essentially of sodium carbonate.

10. An improved process as in claim 9 wherein said organic liquid is selected from the group consisting of fuel oil, fatty acids and mixtures thereof.

11. An improved process as in claim 9 wherein said organic liquid is selected from the group consisting of fuel oil, tall oil and mixtures thereof.

12. An improved process for separating phosphate values from a sized Florida phosphate ore comprising forming an aqueous slurry of the sized phosphate ore, forming a mixture of said slurry of sized phosphate ore with at least one organic liquid to make the surface of the phosphate ore hydrophobic, and subjecting said mixture to a flotation step, in the absence of any phospho-organic depressants for said silica, the improvement comprising adjusting the pH of said mixture to a pH of at least about 9.8 using an aqueous solution consisting essentially of sodium carbonate, and removing the phosphate content of the ore as a float fraction.

13. The process of claim 12 wherein the pH of said mixture is adjusted to a pH of about 9.8 to about 10.5.

* * * * *